US009398822B2

(12) United States Patent
Wille

(10) Patent No.: US 9,398,822 B2
(45) Date of Patent: Jul. 26, 2016

(54) RECLOSABLE CONTAINER

(75) Inventor: Manuel Wille, Rankweil (AT)

(73) Assignee: Red Bull GmbH, Fuschl am See (AT)

( * ) Notice: Subject to any disclaimer, the term of this patent is extended or adjusted under 35 U.S.C. 154(b) by 0 days.

(21) Appl. No.: 13/985,278

(22) PCT Filed: Feb. 3, 2012

(86) PCT No.: PCT/EP2012/051888

§ 371 (c)(1),
(2), (4) Date: Oct. 24, 2013

(87) PCT Pub. No.: WO2012/110335

PCT Pub. Date: Aug. 23, 2012

(65) Prior Publication Data

US 2014/0048549 A1 Feb. 20, 2014

(30) Foreign Application Priority Data

Feb. 14, 2011 (DE) ..... 10 2011 011 208

(51) Int. Cl.

*A47G 19/22* (2006.01)
*B65D 43/02* (2006.01)
*B65D 47/08* (2006.01)

(Continued)

(52) U.S. Cl.

CPC ..... *A47G 19/2272* (2013.01); *B65D 43/0222* (2013.01); *B65D 47/0895* (2013.01); *B65D 47/32* (2013.01); *B65D 51/226* (2013.01); *B65D 2251/0018* (2013.01); *B65D 2251/0025* (2013.01); *B65D 2251/0093* (2013.01); *B65D 2543/00046* (2013.01); *B65D 2543/00092* (2013.01); *B65D 2543/00296* (2013.01);

(Continued)

(58) Field of Classification Search

CPC ..... A47G 19/2272; B65D 43/0222; B65D 47/32; B65D 47/0895; B65D 51/226

USPC ..... 220/712, 811, 254.1, 254.3, 265, 303, 220/367.1, 713, 254.9, 345.1, 812, 813, 815

See application file for complete search history.

(56) References Cited

U.S. PATENT DOCUMENTS 4,561,560 A * 12/1985 Lyon ..... 220/278
4,711,363 A * 12/1987 Marino ..... 220/266
4,865,215 A * 9/1989 Wells ..... 220/269

FOREIGN PATENT DOCUMENTS

DE 20 2010 002 240 U1 7/2010
JP 2001-72112 A 3/2001
JP 2001072112 * 3/2001 ..... B65D 47/36
JP 2006-290415 A 10/2006

OTHER PUBLICATIONS

International Search Report dated May 7, 2012, in International Application No. PCT/EP2012/051888, filed Feb. 3, 2012, 4 pages.

*Primary Examiner* — Fenn Mathew
*Assistant Examiner* — Elizabeth Volz
(74) *Attorney, Agent, or Firm* — Seed IP Law Group PLLC

(57) ABSTRACT

A container (1) having a lower part (2) and a lid (3) which covers the lower part (3), wherein the lid (3) has a closure (4) that can be moved from a first position into at least one further position, wherein the lower part (3) is fully closed by a covering (5), and the closure (4) is configured such that at least one opening (13) is realized in the covering (5) when the closure (4) is moved from the first position into the at least one further position. Further movement of the closure (4) to a third position exposes the at least one opening (13), allowing access to a medium stored in the container (1).

7 Claims, 4 Drawing Sheets

(51) Int. Cl.
*B65D 47/32* (2006.01)
*B65D 51/22* (2006.01)

(52) U.S. Cl.
CPC ..... *B65D2543/00527* (2013.01); *B65D 2543/00537* (2013.01)

(56) References Cited

FOREIGN PATENT DOCUMENTS

| | | | | |
|---|---|---|---|---|
| JP | 2006290415 | * | 10/2006 | ..... B65D 47/36 |
| WO | 2009/022745 | A1 | 2/2009 | |

* cited by examiner

RECLOSABLE CONTAINER

FIELD

The present disclosure relates to a container and a way of using such a container.

BACKGROUND

Containers, for example, beverage cans made of a light metal material, are generally known. These containers hold a beverage, for example, and are at first completely hermetically sealed towards the outside. In a lid of such a container, a closure is arranged, which is moved from a first to a further position in order to form an opening in the lid, thus providing access to the beverage held within the container. There are uses where the closure is secured to the lid of the container in such a manner to ensure that it will not be lost. However, this configuration has the drawback that the opening cannot be closed again once it has been formed in the lid and is no longer covered by the closure.

This means there is a general need to provide a container designed to be filled with a medium, in particular a liquid such as a beverage, which is introduced into the container and is at first tightly sealed therein relative to the outside of the container. Actuation of the closure serves to provide access to the medium while ensuring that the opening formed in the container can be closed again if not all of the medium has been removed from the container. A typical example is a carbonated beverage in a beverage can, where the beverage can must be re-closed if not all of the carbonated beverage has been drunk from the beverage can. The same is of course true of other types of beverages, such as hot beverages. Here, the opening formed to remove the beverage should also be reclosable to ensure that the temperature of the hot beverage remains almost constant on the one hand and to prevent the hot beverage from spilling out of the container through the opening due to movement of the beverage can on the other.

To meet the aforesaid needs, a closing and opening device for a container designed to hold a liquid is known from German patent application DE 20 2010 002 240 U1, for example, comprising a lid base that can be secured to the open end of the container and has an axial opening, comprising a bistable lid having a concave geometry in a first stable state following exertion of a first axial force and a convex geometry in its second stable state following exertion of a second axial force. The lid covers the axial opening of the lid base from above. A valve slide, the upper side of which is connected to the lower side of the lid, extends through the axial opening in the lid base and a radially outer portion of which can be arranged in sealing contact with an axially lower sealing surface of the lid base. A pressure relief valve is formed on the valve slide of this liquid removal valve, which pressure relief valve is actuated by exerting an axial force on the lid in the opening direction, in the same way as the valve slide of the liquid removal valve, but wherein the pressure relief valve is actuated in the opening direction before actuating the valve slide. This configuration is suitable for opening the container for first use while relatively small forces are required for actuation. However, the entire structure of the closure device of this known container is extremely difficult and complex, resulting in disadvantages during manufacture, in particular in the case of automated manufacture, and in terms of costs.

SUMMARY AND INITIAL DESCRIPTION

An aspect of the present disclosure is therefore to provide a container and indicate a way of using such a container that ensures easy operation, enables said container to be re-closed and, in addition, allows for rapid and cost-efficient production of such a container, in particular in an automated manner.

In at least one embodiment according to the present disclosure, the lower part of the container is fully closed by a covering and the closure is designed to form at least one opening in the covering when the closure is moved from a first position to at least one further position. At first, the lower part is fully closed by a covering. Said covering may be formed in one piece with the lower part or designed as a separate component. If the covering and the lower part are formed in one piece, it is advantageous if they are already manufactured in one piece. If the covering is a separate component relative to the lower part, it can be affixed to the lower part later, so that the inside of the lower part is fully closed towards the outside environment by the covering. As an alternative, the covering might also be a part of the lid; in this case, the lid and the covering can also be designed in one piece or, alternatively, separate from each other. It is particularly advantageous if the covering is a film or foil. If the covering is a film or foil, it is connected to the lower part in a particularly advantageous manner. If, for example, the lower part and the covering, in particular the film or foil, are made of a plastic material, these two components can be glued, welded, or sealingly connected to each other in an analogous manner, so that the medium, for example a liquid, located in the lower part is hermetically sealed therein relative to the outside environment. This ensures in an advantageous manner that the medium located in the container, in particular in the lower part, will be preserved for longer periods.

Furthermore, the closure is designed to form at least one opening in the covering when the closure is moved from the first position to the at least one further position. In this way, at least one opening can easily be formed in the covering, which at first fully closes the lower part, in order to provide access to the medium located in the lower part. If said opening is a drinking opening, another opening is advantageously provided in addition to said drinking opening for the purpose of pressure compensation (circulation opening).

This means the closure according to the present disclosure is firstly designed and configured to open the covering, which fully closes the lower part, for example to penetrate a film or foil by actuating the closure. In this way, an opening is formed but said opening is still closed in this position of the closure, i.e., after said closure has been moved from its first position to its further, second position. If the closure is moved from this second, closing position to a further, third position, free access is provided to the opening previously formed in the covering, so that the medium located in the lower part can be removed. While in the above explanation a liquid medium is described as an example, other media, such as gel-like or flowable media, are of course also possible.

Another advantage is that the closure, which is now in its third position, can be returned to the second position in order to re-close the opening or the two openings that has/have been exposed. For this purpose, the closure and the associated part of the lid are designed in such a manner that the closure is returned to its second position, in which it tightly seals the at least one opening. It would also be possible, though this is not necessarily an aim in practice, to return the closure from this second position, in which the at least one opening is tightly sealed, to its first, initial position. Normally, this first, initial position (original state) ensures that the covering, which is still intact, is not yet provided with the opening by the closure, and that the at least one opening is not formed until the closure is moved from the first to the second position.

To enable the aforesaid sequence of movements of the closure according to the present disclosure, said closure is supported on the lid both in a linear and a pivotable manner. In a specific configuration, this means the closure is first position moved from its first to its second position in a linear manner. This linear movement can be brought about by pressing the closure in an axial direction of the container from the upper side towards the lower part of the container. Depending on the geometric configuration of the closure, the associated lid, and the lower part, a linear movement at an angle to the axial alignment of the container would also be possible. Once the closure is in its second position, where the at least one opening has been formed in the covering but the covering is not yet accessible, the at least one opening is exposed by simply pivoting the closure. The medium located in the lower part is now freely accessible and can, for example, be poured or drunk. If the closure is pivoted in the opposite direction, i.e., from the third position in which the at least one opening is exposed, back to the second position in which the at least one opening is closed, the at least one opening is closed in a simple manner, so that the remaining medium that is still located in the lower part is arranged in the lower part in a protected manner. As a result, the remaining medium that is still located in the lower part is advantageously protected from losing its effervescence (in particular in the case of a carbonated medium), and the temperature level (for example in the case of a hot beverage) remains almost constant. In the last case, the desired temperature level can be maintained by means of suitable materials of the lower part, the lid, and the closure, and/or by selecting special materials (insulating materials) or a combination of both measures.

Another advantage of the configuration according to the present disclosure is that, due to the fact that the closure is arranged on the lid, the closure is affixed there in such a manner that it cannot be lost, and as a result, no waste is produced during use of the container according to the present disclosure; rather, the container can be disposed of as a whole after use.

In regard to use of such a container according to the present disclosure, the lower part is at first fully closed by a covering, and actuation of the closure causes at least one opening to be formed in the covering when the closure is moved from the first to the at least one further position. This means the closure is actuated (pressed) in a linear manner by means of a simple movement of the hand in order to first form the opening in the covering. Once the closure has advantageously been moved from its first position to its at least one further position due to this action, the opening is (or more than one openings are) formed in the covering but said opening(s) is (are) not yet accessible. In other words, while movement of the closure from the first to the second position causes the opening to be formed in the covering, the medium located in the lower part cannot yet be removed. Removal of the medium located in the lower part is not possible until the closure is advantageously moved to a third position, preferably by means of a pivoting movement, in order to expose the at least one opening in the covering, after moving said closure from the first position to the second position, preferably by means of a linear movement. Another advantage is that the aforesaid movement of the closure from the second position to the third position is reversible, thus re-closing the at least one opening, which was previously exposed, after the closure has been returned from its third position to its second position. Yet another advantage is that these two movements (from the second position to the third position and back) can be repeated as often as desired.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

The container described above and the use of such a container will now be explained in more detail with reference to an exemplary embodiment shown in the figures.

Figure 1:
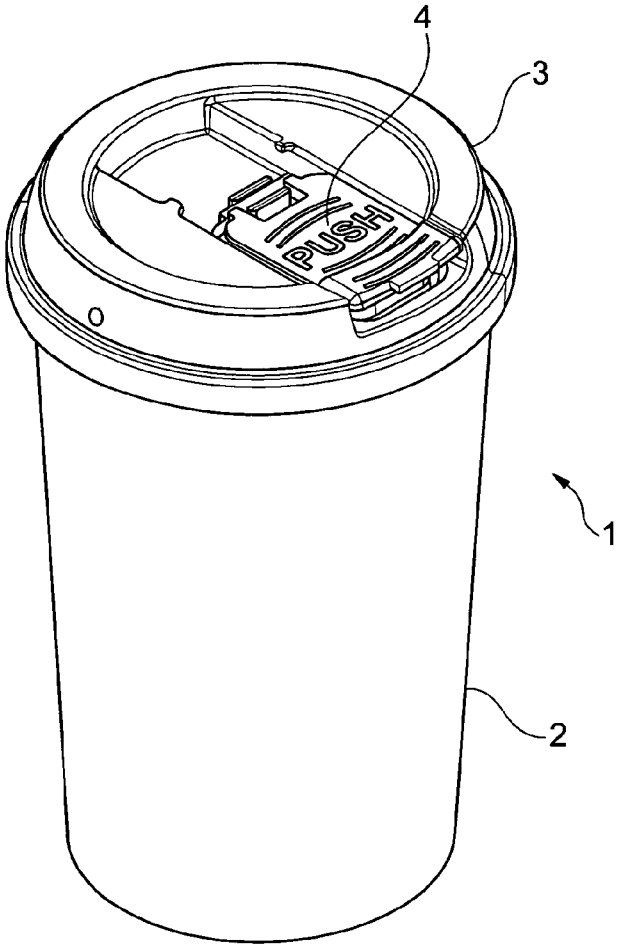
FIG. 1 depicts a container that comprises a lower part and a lid with a closure in accordance with the present disclosure.

FIG. 1, so far as illustrated in detail, shows a container 1 that comprises a lower part 2 and a lid 3 including a closure 4. All aforesaid components of the container 1 may be made, for example, of the same type of material or the same material (for example, plastic or a light metal material such as aluminium), although the individual components might also be made of different materials. It is particularly advantageous if the lower part 2, the lid 3, and the closure 4 are made of a plastic material, and said components of the container 1 are easy to produce in a simple and cost-efficient manner, in particular in large numbers, by means of a plastic injection moulding process. However, neither said production method nor the geometry of the container 1 shown by way of example is a compulsory feature of the present disclosure. In particular, other geometries of the container 1 are possible and certainly not excluded.

If a plastic material is used, the lower part 2 and the lid 3 can be produced by means of an injection moulding process. Another option to produce the lower part 2 and/or the lid 3 from a plastic material is a deep drawing process. If said components consist of a metal material, in particular a light metal material such as aluminium, they can also be produced by means of a blow-moulding process, a rolling/pressing process, or a similar method. For hygienic reasons, the closure 4 is advantageously made of a plastic material or a metal material as well, in particular also by means of an injection moulding process. The above list of production methods is not exclusive; depending on the structure of the part to be produced, other methods can be used.

Figure 2:
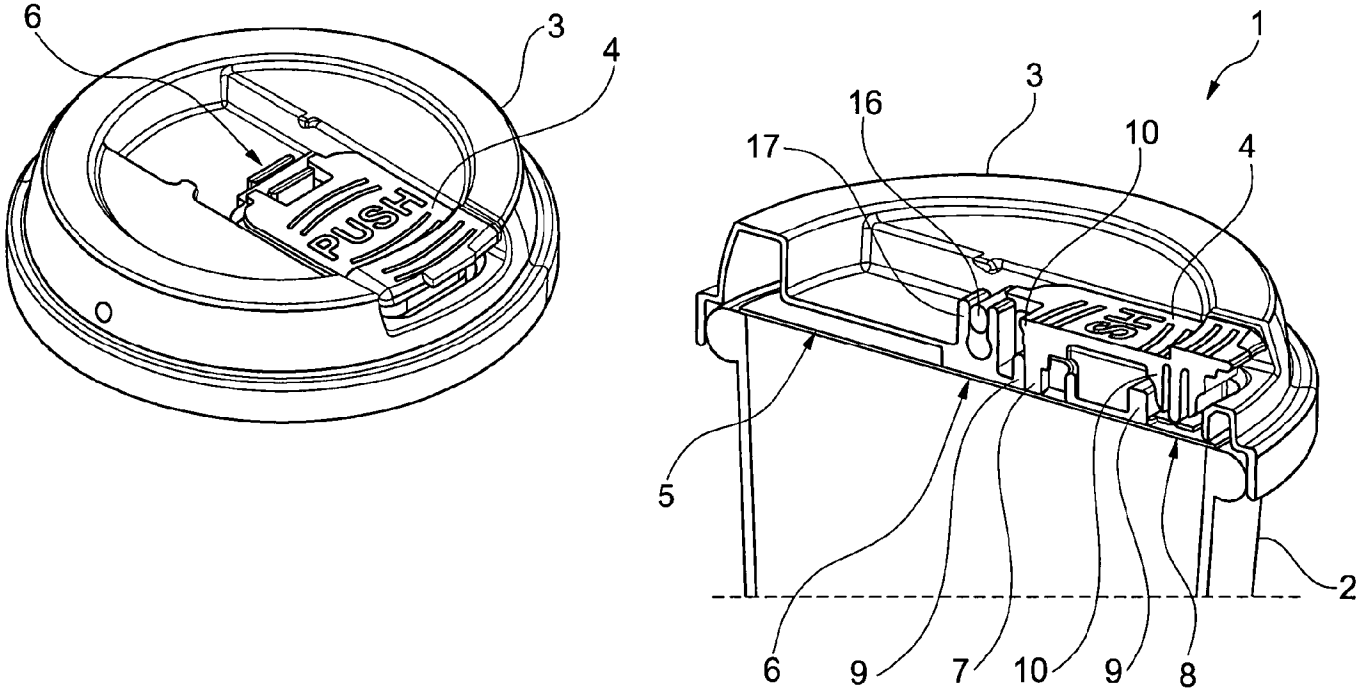
FIG. 2 shows a view of the lid on the left-hand side and a section of an upper part of the container on the right-hand side.

FIG. 2 shows a view of the lid 3 on the left-hand side and a section of the upper part of the container 1 on the right-hand side. The illustration on the right shows that the lower part 2 is provided with a covering 5. In this exemplary embodiment, the covering 5 is, for example, a film or foil that constitutes a separate component relative to the lower part 2 and the lid 3. Said covering 5 is tightly sealed to the circumferential upper edge of the lower part 2 once a medium (not shown) has been filled into the lower part 2 of the container 1. After the lower part 2 has been filled and closed, the lid 3, already prepared with the closure 4, is put on. For reasons of practicality, the lid 3 has already been provided with the closure 4 according to the illustration on the left of FIG. 2, wherein the closure 4 is arranged in a support 6 on the lid 3 in such a manner that it can be moved but not be lost.

As an alternative to the aforesaid configuration, the covering 5 might not be affixed to the lower part 2 but the covering 5 might be produced in one piece with the lid 3 or be affixed to the lid 3, in particular to its circumferential lower edge, as a separate component. In this case, the lower part 2 and the lid 3 should be tightly sealed to each other when the lid 3 including its covering 5 are put on the lower part 2. This can, for example, be achieved by forming a tightly sealed, permanent connection between the lid 3 and the lower part 2 (for example by gluing, welding, or the like). As an alternative, the lid might contact the lower part 2 in a highly pre-tensioned state in order to effectively seal in the medium located in the lower part 2 relative to the outer environment.

The illustration on the right of FIG. 2 also shows that the closure 4 has a projection 7 and a projection 8. If just one opening is to be formed in the covering 5 by actuation of the closure 4, it is sufficient if the closure 4 has one projection (either only projection 7 or only projection 8) facing the covering 5. If, however, two openings are to be formed in the covering 5 by actuation of the closure 4, the closure 4 must have two projections 7, 8 facing the covering 5. The one projection 7 or 8 or both projections 7, 8 can have the same geometry or be different from each other. At their ends, the two projections 7, 8 are (or the one projection 7 or 8 is) designed in such a manner that actuation of the closure and movement from its first position to its second position causes the covering 5 to be penetrated in order to form the at least one opening.

In the area around the opening to be formed later, the lid has a circumferential edge 9. The circumferential edge 9 of the lid 3 corresponds to a circumferential edge 10 of the closure 4. In this position of the closure 4, i.e., at a distance from the lid 3, the end of the at least one projection 7, 8 as well as the upward-facing end portion of the at least one circumferential edge 9 are at a distance from the at least one circumferential edge 10 of the closure 4. This means the covering 5 is intact in this state of the container 1 shown in FIG. 2, and as a result, the medium located in the lower part 2 is completely hermetically sealed relative to the outside environment of the container 1. The closure 4 is therefore in its initial, first position (state at delivery of the lid 3 or the entire container 1).

Figure 3:
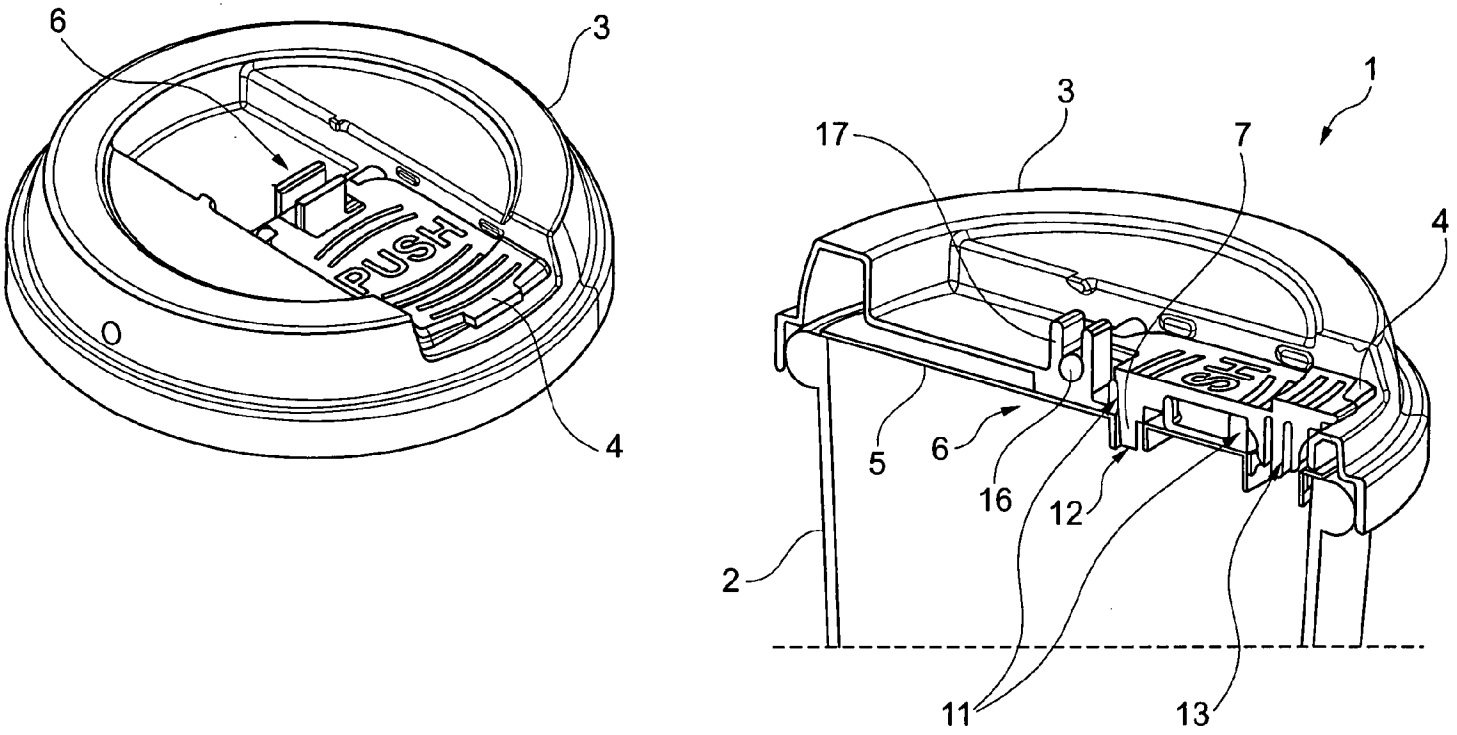
FIG. 3 shows a view of the lid including its closure on the left-hand side and a section of the container on the right-hand side.

FIG. 3 again shows the lid 3 including its closure 4 in the illustration on the left-hand side and a section of the container 1 on the right-hand side. It can be clearly seen that the closure 4 has been moved from its first position to its further, second position by means of a linear movement. Said linear movement was brought about by pressing the upper side of the closure 4 in the direction of the lower part 2. The closure 4 pressed downwards in the support 6 can be clearly seen in the illustration on the left of FIG. 3, while the illustration on the right of FIG. 3, shows in addition that the at least one projection 7, 8 of the closure 4 has (in this exemplary embodiment, both projections 7, 8 of the closure 4 have) penetrated the covering 5. Once this linear movement is complete, the covering 5 has been penetrated by the at least one projection, preferably both projections 7, 8, and the at least one circumferential edge 9, preferably both circumferential edges 9, of the lid 3 and the at least one corresponding edge 10, preferably both corresponding edges 10, of the closure 4 are in contact 11 with each other. Said contact 11 ensures that the openings 12, 13 formed in the covering 5 by means of the projections 7, 8 remain tightly sealed towards the outside of the container 1. This also means, for example, that accidental actuation of the closure 4 by pressing it down will not yet provide access to the medium located in the lower part 2 from the outside environment. As a result, the container 1 is at first effectively protected in case of accidental actuation of the closure 4.

Depending on the type of medium located in the lower part, only one opening, i.e., a removal opening, may be formed in the covering 5 by the aforesaid actuation of the closure 4. It is sufficient to form only one opening in the covering 5 if said opening is sized such that the medium can be removed from the lower part 2 without problems. However, if the container is, for example, a beverage can and a beverage is located in the lower part 2, it is advantageous if actuation of the closure 4 causes two openings to be formed in the covering 5. In this case, one of the two openings is advantageously a circulation opening 12, which is provided at a distance from the edge of the lid 3. Said circulation opening 12 serves the purpose of pressure compensation between the outside and the inside of the container 1. In addition, a drinking opening 13 is provided for removal of the beverage from the lower part 2. As a rule, it is sufficient if the surface area of the opening 13 is selected to be larger, preferably much larger, than the cross-sectional area of the circulation opening 12. The drinking opening 13 is located near the edge of the lid 3 in order to facilitate access.

Figure 4:
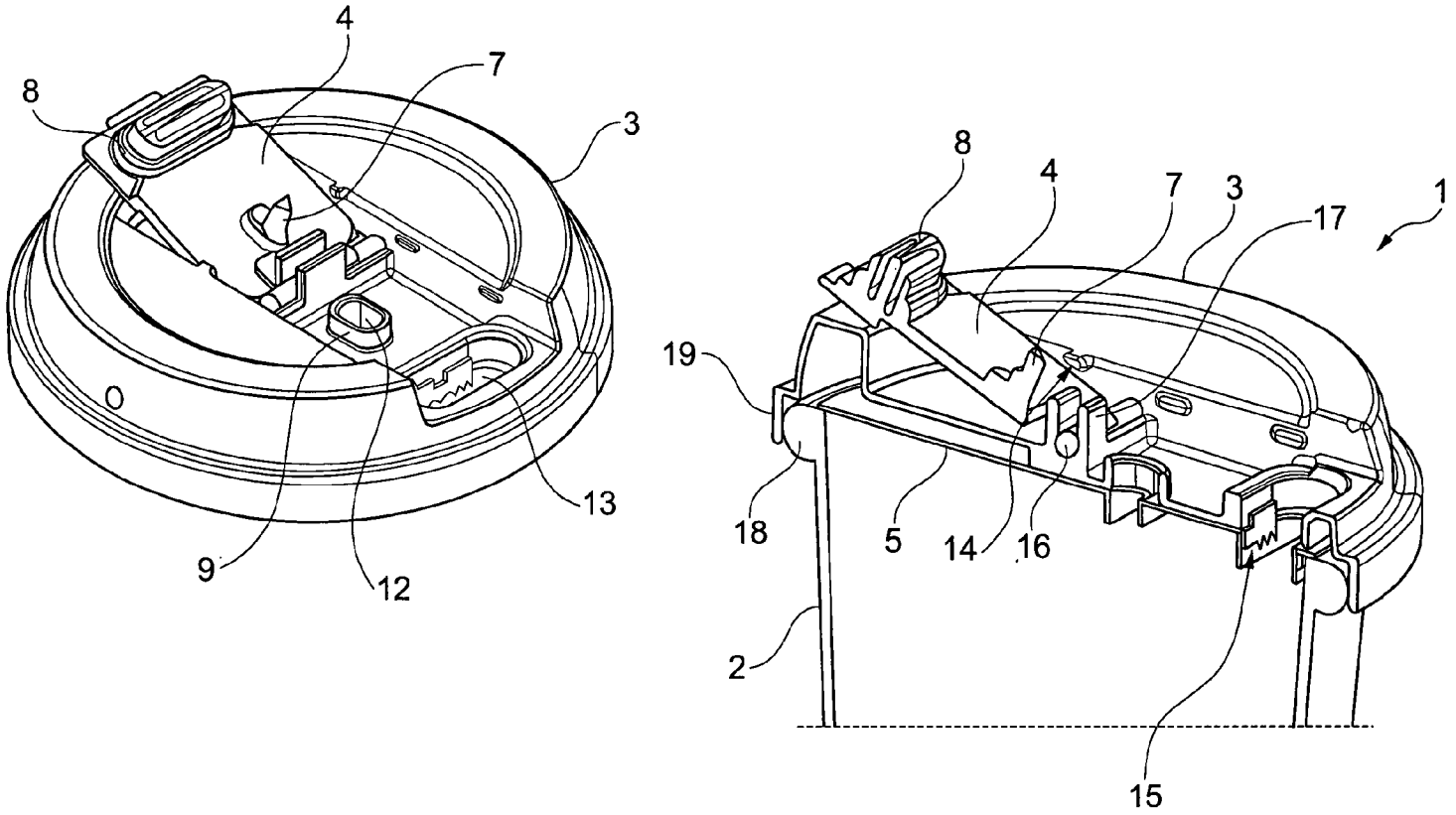
FIG. 4 illustrates pivoting movement of the closure from a second position (FIG. 3) to a third position thus exposing an opening to the lower part of the container.

While it has been shown and described with reference to FIG. 3 that the at least one opening 12, 13 has now been formed in the covering 5, it is not yet possible to remove the medium located in the lower part 2 through the at least one opening in this position. For this purpose and as shown in FIG. 4, the closure 4 must be moved from its second position (FIG. 3) to a third position (FIG. 4) by way of a pivoting movement. As can be clearly seen in FIG. 4, the closure 4 has been pivoted about an axis of rotation of the support 6. As a result, the at least one opening 13 is, in particular both openings 12, 13 are, exposed.

Here, it is particularly advantageous if the closure 4 is locked in the third position, for example, by means of a lug 14 arranged on the lid 3. This means the closure 4, which is held in its third position by way of the lug 14, does not interfere with removal of the medium from the lower part 2 through the opening 13. In FIG. 4, it can also be clearly seen that the opening 13, in particular the drinking opening, has a larger cross-section than the opening 12, in particular the circulation opening provided for pressure compensation. The illustration on the right of FIG. 4 also shows that the lid 3 comprises a film/foil stabilizer 15. Said film/foil stabilizer 15, which may have been arranged as a sheet-like component, for example, on the inner side of the circumferential edge 9 of the lid 3, ensures that the part of the covering 5, which at first closed the opening 13, does not return to its initial position after this portion of the covering 5 was penetrated by the projection 8 of the closure 4. This means the film/foil stabilizer 15 holds the penetrated part of the covering 5, in particular of the film/foil, in the direction of the lower part 2, and prevents the penetrated part of the film/foil 4 from moving back in the direction of the surface of the lid 3 when the medium is removed from the lower part 2 through the opening 13.

The support 6 of the closure 4 on the lid 3, designated by reference numeral 6 in FIGS. 1 to 4, is configured in such a manner that the lid 3 comprises a hinge support 17, wherein a hinge 16 of the closure 4 is arranged in the hinge support 17 in such a manner that the hinge 16 and the hinge support 17 bring about the linear and pivotable movement of the closure 4. This means the hinge support 17 comprises two legs that are approximately U-shaped, wherein the hinge 16, which is affixed to an end face of the closure 4, is at first supported in the upper end portion between the two legs of the hinge support 17 (see FIG. 2). In this state (FIG. 2), an inward-facing projection is provided below the hinge 16 between the two legs of the hinge support 17, which projection holds the hinge 16 in the upper portion of the hinge support 17. Pressure exerted on the closure 4 causes the hinge 16 to pass over said inward-facing projection between the two legs of the hinge support 17, so that said hinge is able to be received in the lower portion of the hinge support 17 (see FIG. 3). This also limits the linear movement of the closure 4. As the hinge support 17 is U-shaped, the hinge 16 can be held in its first position (FIG. 2) on the one hand and moved to its second position (FIG. 3) by exerting little force on the other. As the hinge 16 is, for example, designed as a hinge pin, i.e., cylinder- or tube-shaped, it is also possible to pivot the closure 4 in the area of the support 6 from its second position (FIG. 3) to its third position (FIG. 4). The sequence of movements explained above (linear movement followed by a pivoting movement and back) provides access, in a simple manner, to the medium, which is at first located in the lower part 2 and tightly sealed therein relative to the outside of the container 1 by the covering 5, by actuating the closure 4 to form the at least one opening required, wherein further movement of the closure 4 provides access to said opening. Said at least one opening can also be tightly re-sealed by actuating the closure. In this context, it should be noted that the closure 4 tightly seals the at least one opening, as explained above. Depending on the type of medium located in the lower part 2, it can also be possible that the at least one opening is only closed but not necessarily tightly sealed by the closure 4. This would have the advantage that the closure 4 can have a simpler structure if the type of medium does not require the opening to be tightly sealed.

Referring to the hinge 16 and the hinge support 17, the following additional detail should be mentioned. As can be clearly seen in FIG. 2, the hinge 16 is flattened towards the two upper ends of the U-shaped hinge support 17. The corresponding geometry of the hinge support 17 is formed analogously, so that the hinge support 17 has parallel planar surfaces in its upper part at the height of the hinge 16. This ensures that the closure 4 cannot be pivoted (i.e., the opening cannot yet be opened) in this position. First the closure 4 must be moved from its position shown in FIG. 2 to the further position shown in FIG. 3 in a linear manner before the hinge 16 is able to be pivoted in its lower position in the hinge support where said hinge support has a round cross section. This ensures that, once the at least one opening has been formed, the closure 4 can be pivoted from its position shown in FIG. 3 to the position shown in FIG. 4 in order to expose the at least one opening 13, preferably both openings 12, 13.

The film/foil stabilizer 15 is either a part of the covering 5 or an additional component. In a preferred configuration, the film/foil stabilizer 15 is designed as a living hinge, which is moved when the closure 4 is moved (pressed down) from the position shown in FIG. 2 to the position shown in FIG. 3 in a linear manner. The film/foil stabilizer 15, which is at first aligned parallel to the surface of the covering 5, is bent by approx 90° and prevents the covering 5 penetrated by the closure 4 from re-closing after penetration when the medium is removed from the lower part 2. This means the film/foil stabilizer 15 advantageously causes the opening 13 to remain almost fully opened once the closure 4 has penetrated the covering 5 in this place. The same may, but need not, be true of the opening 12. This means another film/foil stabilizer may, but need not, be provided in the area of the opening 12.

With reference to the exemplary embodiment shown in the figures, it should finally be noted that the lower part 2 comprises a circumferential bead 18. The lid 3 has a circumferential edge 19 corresponding to said circumferential bead 18 of the lower part 2. The bead 18 and the edge 19 are made to correspond to each other in such a manner that the lid 3 can be put on the upper side of the lower part 2 without problems, wherein the bead 18 and the edge 19 are designed in such a manner that the lid 3 is permanently secured to the lower part 2 in such a manner that it cannot be lost. Again, the covering 5 is permanently and tightly sealed (secured) to the lower part 2 before the lid 3 is put on, although the covering 5 might also be a part of the lid 3 instead of the lower part 2 and be put on when the lid 3 is put on.

A particular advantage of the configuration of the container 1, as shown in FIGS. 1 to 4, is one-handed operation. In particular, the cylindrical container 1 shown can be grasped with one hand by the lower part 2 while the closure 4 can, for example, be pressed down with the thumb (sequence of movements shown in FIGS. 2 and 3), wherein the closure 4 can be pivoted, either immediately thereafter or later, using the thumb again, for example (sequence of movements from FIG. 3 to FIG. 4). Likewise, just one hand is needed to return the closure 4 shown pivoted backwards in FIG. 4 to the position shown in FIG. 3, thus re-closing the at least one opening 12, 13, preferably both openings 12, 13. Said advantageous one-handed operation is in particular enabled by the cylindrical container 1 shown in the figures. Depending on the geometric configuration of the container 1, operation with two hands may be necessary; however, one-handed operation as described above is regarded to be particularly advantageous.

LIST OF REFERENCE NUMERALS

1. Container
2. Lower part
3. Lid
4. Closure
5. Covering
6. Support
7. Projection
8. Projection
9. Edge (in particular circumferential)
10. Edge (of the closure)
11. Contact
12. Opening (circulation opening)
13. Opening (drinking opening)
14. Lug
15. Film/foil stabilizer
16. Hinge
17. Hinge support
18. Circumferential bead
19. Circumferential edge

The invention claimed is:

1. A container comprising:

a lower part of the container; and a lid covering the lower part of the container, wherein the lid has a closure that can be moved from a first position to a second position, wherein the closure is attached to the lid both in a linear and a pivotable manner, wherein the lower part of the container is fully closed by a covering and the closure is configured to form at least one opening in the covering when the closure is moved from said first position to said second position, wherein the closure is further configured to move from said second position to a third position to expose said at least one opening in the covering, wherein the closure has at least one projection facing the covering, and wherein the projection causes the at least one opening to be formed in the covering when the closure is moved towards the covering in a linear manner, wherein the lid further comprises a surface and a hinge support, wherein a hinge of the closure is arranged in the hinge support in such a manner that the hinge and the hinge support bring about the linear movement of the closure when the closure is moved from said first position to said second position and the hinge and the hinge support bring about the pivotable movement of the closure when said hinge of the closure is in the second position, and wherein the closure in said second position is pivotable about an axis of upward and downward rotation relative to the lid surface in the hinge support thereby exposing the at least one opening in the covering.

2. The container according to claim 1, wherein the closure has at least one further projection facing the covering, wherein the at least one further projection causes a further opening to be formed in the covering when the closure is moved towards the covering in a linear manner.

3. The container according to claim 1, wherein the covering is separate from the lid and is fixed to a circumferential edge of the lower part of the container.

4. The container according to claim 1, wherein the covering is fixed to a circumferential edge of the lid and covers the lower part of the container when the lid is secured to the container.

5. The container according to claim 1, wherein the lid has a circumferential edge extending around the at least one opening.

6. The container according to claim 5, wherein the closure has at least one circumferential edge that interacts with the circumferential edge of the lid.

7. A method of using a container comprising a lower part and a lid covering the lower part, wherein the lid has a closure that can be moved from a first position to a second position, the closure being attached to the lid both in a linear and a pivotable manner, and wherein the lower part is at first fully closed by a covering, the method comprising:

actuating the closure and causing at least one opening to be formed in the covering when the closure is moved from the first position to the second position, wherein moving the closure from the first position to the second position includes a linear movement of the closure; and moving the closure to a third position using a pivoting movement of the closure relative to the lid in order to expose the at least one opening in the covering after moving the closure from the first position to the second position, wherein the closure has at least one projection facing the covering, and wherein the projection causes the at least one opening to be formed in the covering when the closure is moved from the first position to the second position in a linear manner.

* * * * *